US011166500B2

(12) United States Patent
Stewart et al.

(10) Patent No.: US 11,166,500 B2
(45) Date of Patent: Nov. 9, 2021

(54) REUSABLE, REAR OPENING ISOLATION GOWN WITH EASY RELEASE FASTENER

(71) Applicant: Standard Textile Co., Inc., Cincinnati, OH (US)

(72) Inventors: Richard Stewart, Mason, OH (US); Kimberly A. Turner, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 258 days.

(21) Appl. No.: 16/321,061

(22) PCT Filed: May 19, 2017

(86) PCT No.: PCT/US2017/033513
§ 371 (c)(1),
(2) Date: Jan. 28, 2019

(87) PCT Pub. No.: WO2018/063449
PCT Pub. Date: Apr. 5, 2018

(65) Prior Publication Data

US 2019/0166930 A1 Jun. 6, 2019

Related U.S. Application Data

(60) Provisional application No. 62/400,893, filed on Sep. 28, 2016.

(51) Int. Cl.
*A41D 13/12* (2006.01)

(52) U.S. Cl.
CPC ..... *A41D 13/1209* (2013.01); *A41D 13/129* (2013.01); *A41D 2300/32* (2013.01); *A41D 2400/44* (2013.01)

(58) Field of Classification Search
CPC ..... A41D 13/1209; A41D 13/129; A41D 13/1245; A41D 13/12; A41D 2400/44;
(Continued)

(56) References Cited

U.S. PATENT DOCUMENTS 3,824,625 A * 7/1974 Green ..... A41D 13/1209 2/114
4,014,045 A * 3/1977 Moyer ..... A41D 13/04 2/51

(Continued)

FOREIGN PATENT DOCUMENTS

WO 2014113783 A1 7/2014

OTHER PUBLICATIONS

HookandLoop.com performance measures Duragrip(r) Velcro(r): https://www.hookandloop.com/performance-measures/ (2015) retrieved Feb. 27, 2021.*

(Continued)

*Primary Examiner* — Amy Vanatta
(74) *Attorney, Agent, or Firm* — Wood Herron & Evans LLP

(57) ABSTRACT

A personal protective equipment (PPE) rear opening isolation gown is provided that can be used by workers in the healthcare industry. The isolation gown is reusable and can provide for ease of doffing, such as in a pull forward manner that is consistent with how current users of disposable isolation gowns are accustomed to removing such gowns, without substantial risk of damaging (e.g., tearing) the gown and without substantial risk of the transfer of potentially harmful microorganisms, body fluids, and/or particulate material, to the neck or hair on the head or neck of a wearer. The reusable, rear opening isolation gown is provided with an easy release fastener(s) that provides a safe and secure
(Continued)

hold when fastened but permits the gown to be removed easily, quickly, and more safely than other reusable options.

21 Claims, 8 Drawing Sheets

(58) Field of Classification Search
CPC ..... A41D 2300/32; A41D 13/1236; A41D 10/00; A41D 11/00; A41D 13/04; A41D 13/1254; A41D 13/1263; A41D 13/1272; A41B 18/00; A41B 18/0003; A41B 18/0046; A41B 18/0069; A41B 18/0073; A41B 2400/44; A41B 2300/32
USPC ..... 2/114, 51
See application file for complete search history.

(56) References Cited

U.S. PATENT DOCUMENTS 4,106,120 A 8/1978 Zurbrigg et al.
4,570,268 A 2/1986 Freeman
4,644,590 A * 2/1987 Pincham ..... A41D 13/1245 2/115
5,315,716 A * 5/1994 Baum ..... A41D 1/06 2/114
8,307,462 B1 * 11/2012 Kenney Purcaro .... A41D 13/04 2/48
2010/0031419 A1 * 2/2010 Halseth ..... A41D 13/12 2/114
2011/0154554 A1 6/2011 Furlong
2012/0054940 A1 3/2012 Halseth
2013/0091616 A1 * 4/2013 Muche ..... A41D 13/1236 2/114
2014/0367594 A1 12/2014 Reynolds
2015/0135398 A1 * 5/2015 Czajka ..... A41D 13/12 2/114
2015/0150318 A1 * 6/2015 Terrell ..... A41D 13/1281 2/114
2019/0150534 A1 * 5/2019 Jascomb ..... A41D 27/18

OTHER PUBLICATIONS

PCT Office, International Preliminary Reporton Patentability issued in corresponding PCT/US2017/033513 dated Apr. 2, 2019, 13 pages.
PCT Office, Search Report and Written Opinion issued in corresponding PCT/US2017/033513 dated Jul. 27, 2017, 19 pages.

* cited by examiner

REUSABLE, REAR OPENING ISOLATION GOWN WITH EASY RELEASE FASTENER

CROSS REFERENCE TO RELATED APPLICATION

This application claims the benefit of U.S. Provisional Patent Application Ser. No. 62/400,893, filed Sep. 28, 2016 and hereby incorporated by reference in its entirety.

TECHNICAL FIELD

The present invention relates generally to healthcare apparel and, more specifically, to personal protective equipment (PPE) rear opening isolation gowns, such as for use by workers in the healthcare industry.

BACKGROUND

Isolation (or precaution) gowns are identified as the second-most-used piece of PPE, following gloves, in the healthcare setting. The isolation gown is intended to protect healthcare patients and personnel (e.g., doctors and nurses) from the transfer of potentially harmful microorganisms, body fluids, and/or particulate material. The gown generally covers the torso and clothing of a wearer acting as a physical barrier against the transfer of such microorganisms and other materials.

Isolation gowns should facilitate easy donning and doffing (removal) without self-contamination by the wearer. The isolation gown also should not restrict the movement of the body and should be breathable and comfortable to wear. Many different types of isolation gowns are currently available to healthcare workers with varying protection levels. Most of the isolation gowns in the market are of a rear opening style. Many of these rear-opening styles are disposable and, thus, generally designed for a single-use.

Certain disposable/single-use gowns utilize a system of closures (or fasteners) including backside neck and/or waist ties, which are designed to simplify donning of the gown and help provide "full body" protection for the wearer. And for doffing, such isolation gowns are commonly removed via a "pull forward" method, whereby the wearer (or another individual) grabs the front of the gown and pulls forcefully forward or away from the wearer's body until, for example, the gown fabric tears completely away from the tie closure (s) or vice-versa. To that end, the gown fabric and/or the tie itself is formed of such a material that it can be broken away or torn apart from the other if enough force is exerted during the pull forward method so as to allow the wearer to effectively doff the gown. This method eliminates the need to actively undo/untie any backside closure(s), and eliminates an opportunity for the wearer to touch their hair or neck with potentially contaminated gloves, thereby providing for safer removal of the gown after use. Although providing a certain level of convenience, disposable gowns can be viewed as environmentally unfriendly and, in the long run, may be more costly than isolation gowns that are designed for reuse/multi-use.

As an alternative to the disposable rear opening gown, the marketplace offers rear opening gown options that are designed for multi-use and which must be subjected to regular commercial laundering as a result. These types of gowns also generally utilize a system of fasteners, including backside neck and/or waist ties, which also are designed to simplify donning of the gown and help provide "full body" protection for the wearer. However, unlike disposable gowns, the pull forward method of removal has not previously been an option for gowns intended for reuse/multiple use. Notably, the fabric of the gown and the fasteners conventionally employed at the neck and/or waist for reusable rear opening gowns are not at all intended or designed to be easily broken apart/damaged. Indeed, the steadfastness of the fasteners and hardiness of the gown fabric of reusable gowns prohibits the use of the pull forward method, which would negatively impact the reusable life of the gown, such as by rendering the gown unsafe and ineffective for additional uses, and is completely contrary to its intended reusability.

Accordingly, the intended reusability of the gowns for subsequent safe and effective reuse necessitates that the reuseable gown be doffed without being damaged. At present, that requires wearers to reach behind and actively undo/untie any backside fasteners. However, as indicated above, backside untying/undoing, for example, can significantly increase the likelihood of harmful microorganisms and other materials contacting the neck or hair on the head or neck of a wearer, which can be unsafe and is highly undesirable.

It thus would be beneficial to provide an improved PPE rear opening isolation gown, such as for use in the healthcare industry, that is reusable and which can provide for ease of doffing, such as in a pull forward manner that is consistent with how current users of disposable isolation gowns are accustomed to removing such gowns, without substantial risk of damaging (e.g., tearing) the gown and without substantial risk of the transfer of potentially harmful microorganisms, body fluids, and/or particulate material, to the neck or hair on the head or neck of a wearer.

SUMMARY

The present invention relates to PPE rear opening isolation gowns, such as for use in the healthcare industry, that are reusable and which can provide for ease of doffing without substantial risk of damaging (e.g., tearing) the gown and without substantial risk of the transfer of potentially harmful microorganisms, body fluids, and/or particulate material, to the neck or hair on the head or neck of a wearer. To that end, the reusable, rear opening isolation gown is provided with an easy release fastener(s) that provides a safe and secure hold when fastened but permits the gown to be removed easily, quickly, and more safely than other reusable options, such as in a pull forward manner that is consistent with how current users of disposable isolation gowns are accustomed to removing such gowns.

In one embodiment, a rear opening isolation gown is provided that includes a central body that wraps around a torso area of a wearer, a pair of opposing left and right sleeves that cooperate with and extend in a direction away from the central body, and a neck opening that accommodates a neck of the wearer. The central body and right and left sleeves include a front and a back. The back of the central body is separated into a right portion and a left portion, with one of the right or left portions including an overlapping section and the other portion including a corresponding overlapped section that is defined when the gown is donned and secured. The rear opening isolation gown also includes a plurality of fasteners provided at the back, with each fastener having corresponding first and second parts that cooperate with one another to define the fastener and secure the right and left portions together. Each first part is situated on the overlapping section of the right or left portion and each corresponding second part is situated on the corresponding overlapped section of the other portion of the gown. At least one of the plurality of fasteners is a hook and loop fastener that is situated proximate the neck opening and that facilitates ease of adjustment and donning and doffing of the gown, wherein when the front of the gown is pulled away from the wearer with enough force the hook and loop fastener comes undone without substantial risk of damaging the gown thereby allowing for reuse of the gown.

In another embodiment, a rear opening isolation gown is provided that includes a central body that wraps around a torso area of a wearer, a pair of opposing left and right sleeves that cooperate with and extend in a direction away from the central body, and a neck opening that accommodates a neck of the wearer. The central body and right and left sleeves include a front and a back and are formed from a lint free material. The back of the central body is separated into a right portion and a left portion, with one of the right or left portions including an overlapping section and the other portion including a corresponding overlapped section that is defined when the gown is donned and secured. The rear opening isolation gown also includes a plurality of fasteners provided at the back, with each fastener having corresponding first and second parts that cooperate with one another to define the fastener and secure the right and left portions together. Each first part is situated on the overlapping section of the right or left portion and each corresponding second part is situated on the corresponding overlapped section of the other portion of the gown. At least one of the plurality of fasteners is a hook and loop fastener having an average peel strength in a range from 0.1 PIW to 1.5 PIW and/or an average sheer strength in a range from 5 PSI to 25 PSI, that is situated proximate the neck opening, and that facilitates ease of adjustment and donning and doffing of the gown, wherein when the front of the gown is pulled away from the wearer with enough force the hook and loop fastener comes undone without substantial risk of damaging the gown thereby allowing for reuse of the gown.

In yet another embodiment, a method of doffing a rear opening isolation gown is provided that includes pulling apart first and second parts of a hook and loop fastener on a back of the rear opening isolation gown that securely cooperate with one another to define the fastener by pulling a front of the rear opening isolation gown away from a wearer of the gown with enough force to undo the hook and loop fastener without substantial risk of damaging the gown thereby allowing for reuse of the gown. The hook and loop fastener has an average peel strength in a range from 0.1 PIW to 1.5 PIW and/or an average sheer strength in a range from 5 PSI to 25 PSI and is situated proximate a neck opening of the gown.

BRIEF DESCRIPTION OF THE DRAWINGS

The accompanying drawings, which are incorporated in and constitute a part of this specification, illustrate embodiments of the invention and, with a detailed description of the embodiments given below, serve to explain the principles of the invention.

DETAILED DESCRIPTION OF SPECIFIC EMBODIMENTS

Figure 1:
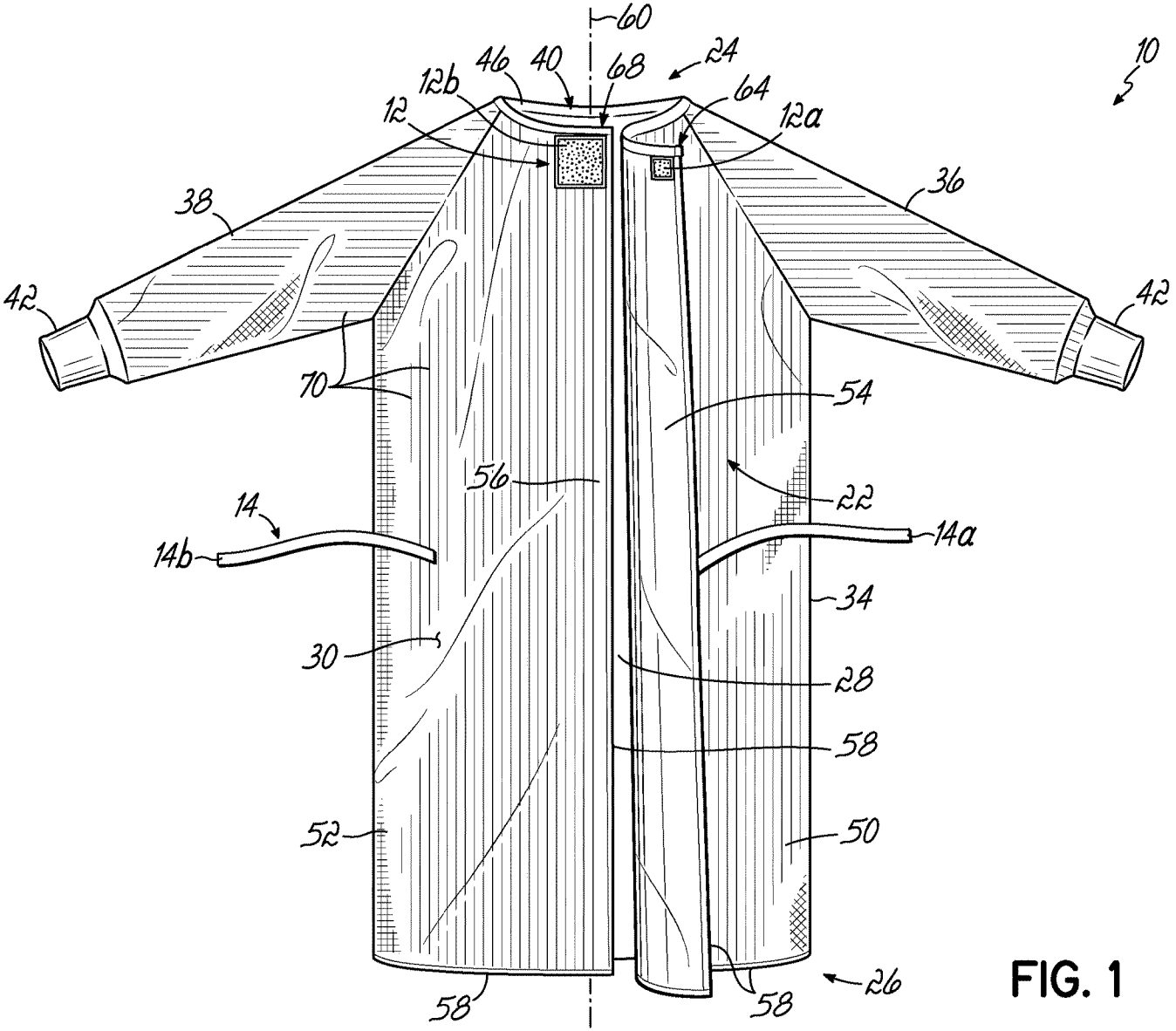
FIG. 1 is a back elevational view of an isolation gown, in a generally open and unsecured position, in accordance with an embodiment of the present invention.

FIGS. 1-4 show a reusable isolation gown 10 in accordance with embodiments of the present invention. The isolation gown 10, which is reusable, has a rear opening configuration and is further designed with fasteners 12 and 14 that facilitate ease of adjustment and donning of the gown and help provide "full body" protection for the wearer. At least one of the fasteners, i.e., fastener 12, facilitates doffing of the gown, such as in a pull forward manner that is consistent with how current users of disposable isolation gowns are accustomed to removing such gowns, without substantial risk of damaging (e.g., tearing) the gown and without substantial risk of the transfer of potentially harmful microorganisms, particularly to the neck or hair on the head or neck of a wearer. To that end, fastener 12 defines an easy release fastener, as further explained below, that provides a safe and secure hold when fastened but permits the desired aforementioned doffing, while also facilitating ease of adjustment and donning of the gown.

Use of the descriptive terms such as left, right, top, bottom, front, back, vertical and/or horizontal hereinbelow, for example, as it pertains to/describes the gown 10, is from the viewpoint of a wearer of the isolation gown 10 (when properly donned), unless otherwise noted.

With reference to FIGS. 1-4, the reusable, rear opening isolation gown 10 generally includes a front 20 (See FIG. 3) and a back 22, a top 24 and a bottom 26, and an inner and outer surface 28 and 30. The isolation gown 10 also includes a central body 34 and a pair of opposing long sleeves, i.e., right and left long sleeves 36 and 38, with each sleeve 36, 38 located adjacent and extending in a direction away from a neck opening 40 and having an optional terminal cuff 42. The neck opening 40 is generally defined by the top edge 46 of the central body 34 and the right and left sleeves 36, 38, and may be hemmed, in one example, to have a bias bound hem. The sleeves 36, 38 may be joined to the central body 34 and the cuffs 42 may be joined to their respective sleeve 36, 38 by techniques known in the art, such as by sewing. As shown here, the sleeves 36, 38 are of a raglan style, but may be of a set-in style (See FIG. 1A). Other sleeve styles may be utilized here as well. With a set-in style sleeve, as shown in FIG. 1A, a proximal end of each sleeve 36, 38 is spaced apart from the neck opening 40. To that end, the neck opening 40 is generally defined by the top edge 46 of the central body 34 alone.

One or more of the optional terminal cuffs 42, in other embodiments, may be absent altogether, with the long sleeve(s) 36, 38 simply defining an opening that is hemmed at a distal end of each sleeve 36, 38. In other embodiments, the terminal cuff 42 may be replaced with long sleeves having thumb loops (not shown), for example. And although the central body 34 and the sleeves 36, 38 are shown as separate pieces stitched together, such as by means known in the art, it should be appreciated that the central body 34 and sleeves 36, 38 could be fastened together by any means or formed of a single piece. In addition, the central body 34 can be formed of a single piece of material, or two pieces (e.g. a front and back) or more than two pieces with the pieces being stitched or fastened together, by means known in the art.

Figure 1A:
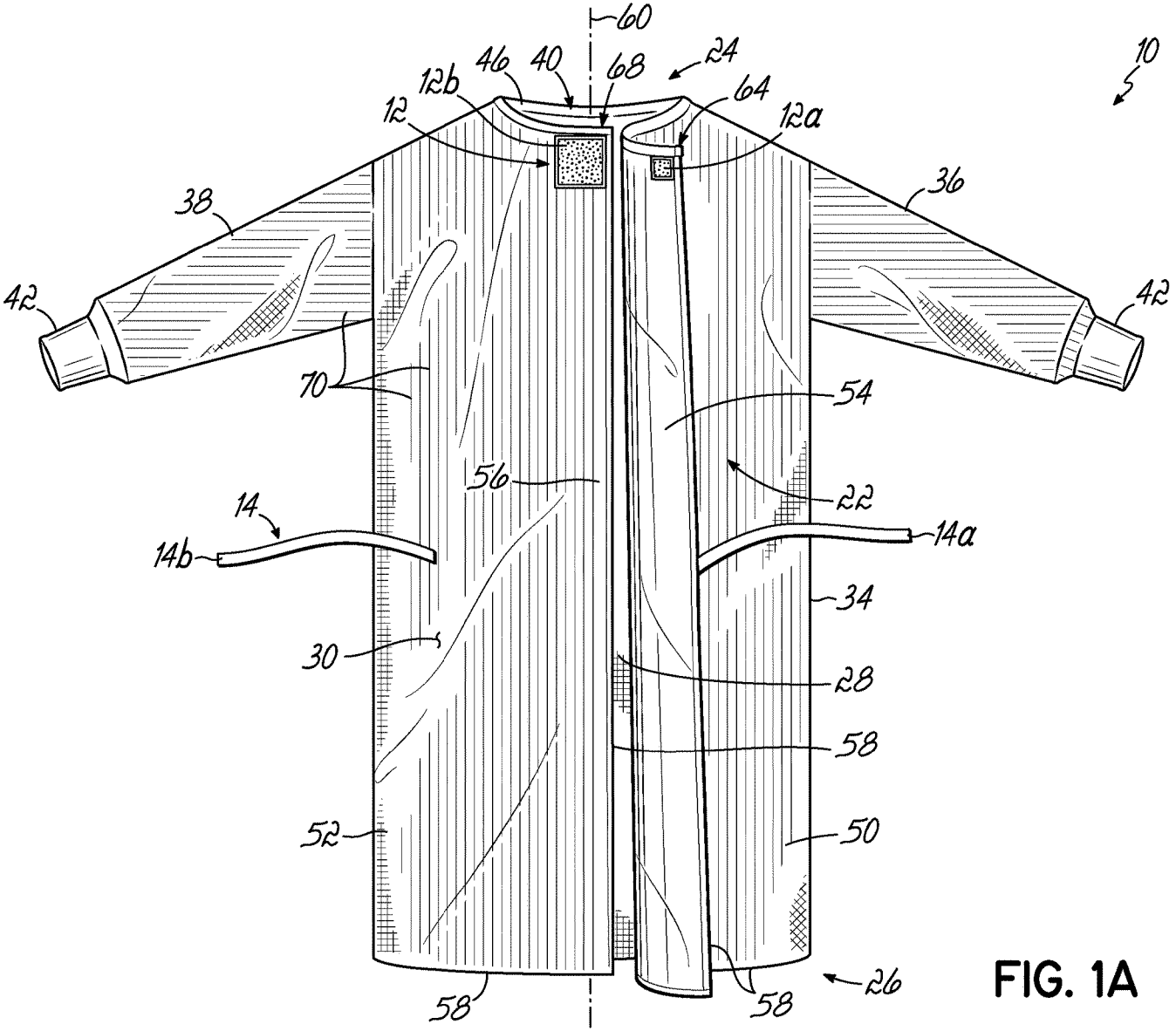
FIG. 1A is a back elevational view of an isolation gown, in a generally open and unsecured position, showing a set-in style sleeve in accordance with another embodiment of the present invention.
Figure 2:
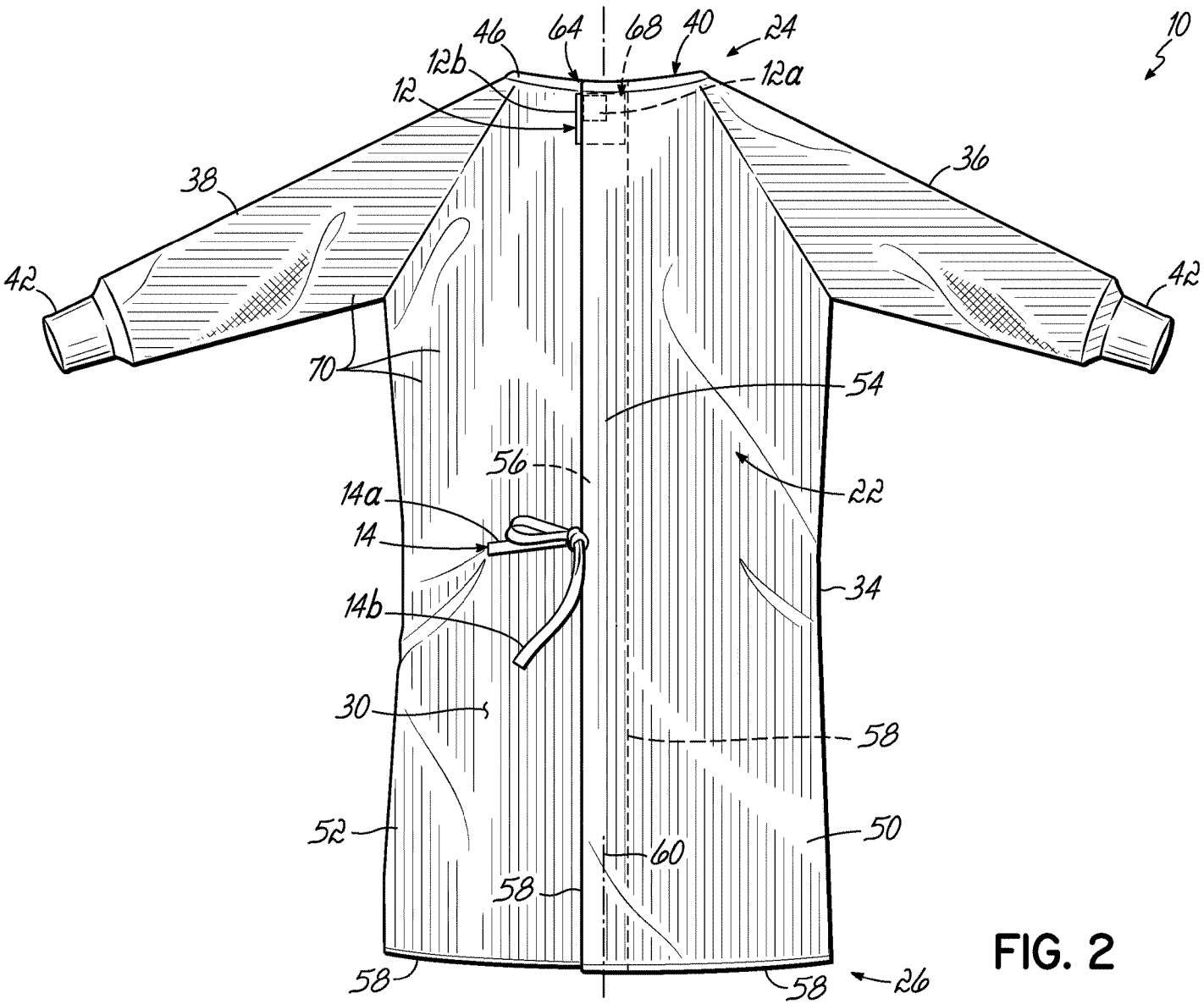
FIG. 2 is a back elevational view of the isolation gown of FIG. 1, in a closed and secured position.
Figure 3:
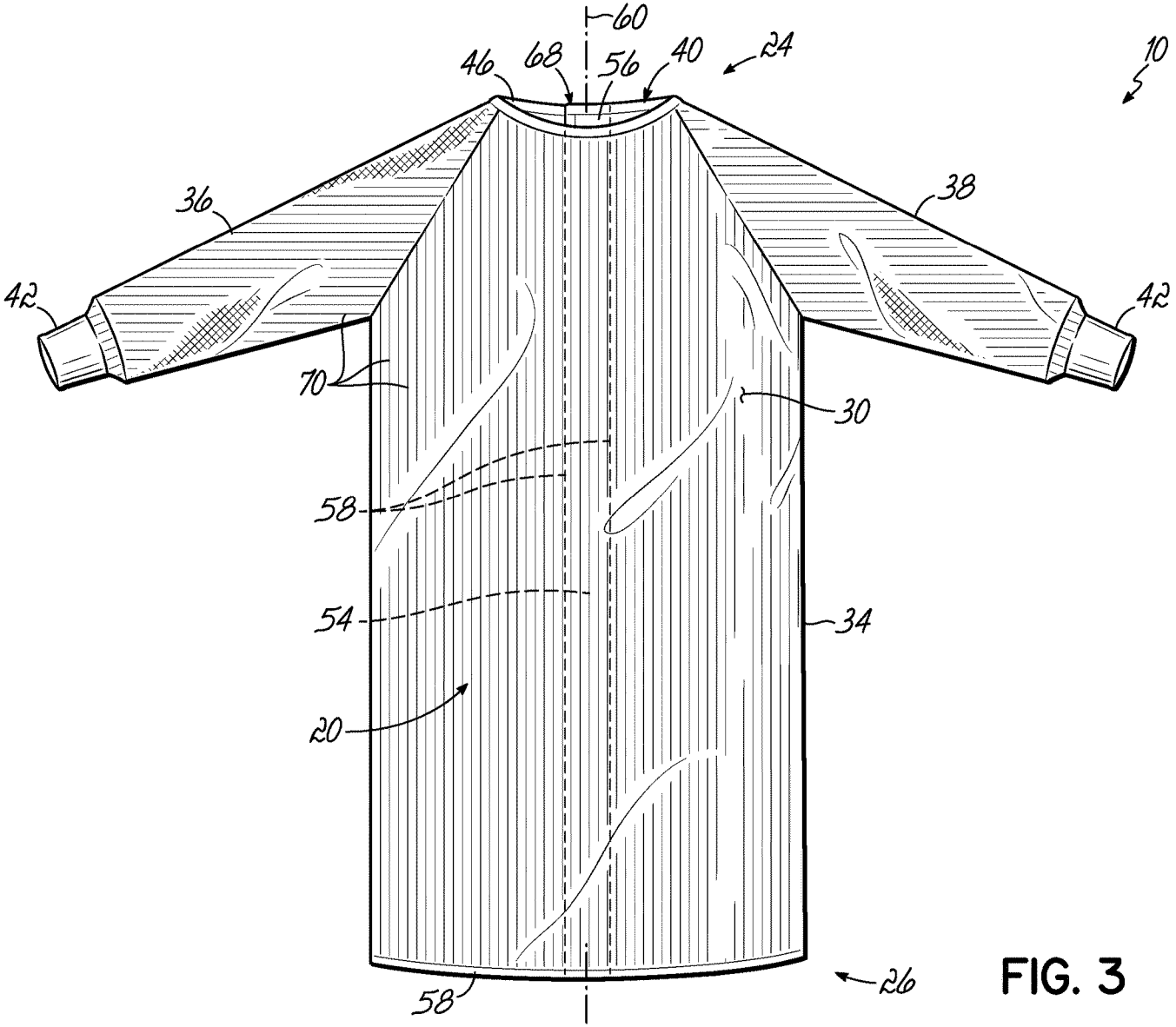
FIG. 3 is a front elevational view of the isolation gown of FIG. 2.

With further reference to FIGS. 1 and 2, the back of the central body 34 of the gown 10 is further separated into a right and left portion 50 and 52 with the right portion 50 including an overlapping section 54 that overlaps a corresponding overlapped section 56 of the left portion 52, when an appropriately sized gown is properly donned and secured. The amount of overlap of the overlapping section 54 may vary as desired. The remaining edges 58 of the central body 34 of the gown 10, including the right and left portions 50, 52, may be conventionally hemmed, with the vertical edge 58 of the left portion 52, in one example, terminating at about a midline 60 of the gown 10.

The fasteners 12, 14 are provided on the inner and outer surfaces 28, 30 at the back 22 of the gown 10 for securing the right and left portions 50, 52 together when the gown is worn. As shown in FIGS. 1 and 2, two fasteners 12, 14 are provided on the gown 10 to provide a secure, full body fit for a wearer and to facilitate ease of adjustment and donning and removing the gown without substantial risk of the transfer of potentially harmful microorganisms. As indicated above, at least one fastener, i.e., fastener 12, defines an easy release fastener. That is, fastener 12 provides a safe and secure hold when fastened but permits the gown to be removed easily, quickly, and more safely than other reusable options. Removal, which is discussed in more detail below, can be achieved, for example, by pulling forward on the gown 10 in a manner that is consistent with how current users of disposable isolation gowns are accustomed, without substantial risk of damaging (e.g., tearing) the gown, while also facilitating ease of adjustment and donning of the gown. To that end, the easy release fastener 12 includes a desired average peel strength and/or desired average shear strength that allows the fastener 12 to come undone when the gown is pulled forward with enough force to accomplish the aforementioned doffing process. Further to that end, the fastener 12 is made of material that is able to repeatedly withstand commercial laundering conditions, such as high temperature and/or acidic and/or basic pH conditions, typically encountered by reuseable gowns.

As best shown in FIGS. 1 and 2, each of the fasteners 12, 14 has corresponding first and second parts 12*a*, 12*b*, 14*a*, and 14*b* that mate or cooperate with one another to define the fastener 12, 14. Easy release fastener 12 defines a hook and loop fastener having a mating hook and loop part 12*a*, 12*b*. The hook (or loop) part 12*a* may be secured by techniques known in the art to the inner surface 28 of the overlapping section 54 of the right portion 50 of the gown 10 proximate a junction 64 at which the top edge 46 or bias bound hem of the neck opening 40 meets the vertical edge 58 or hem of the right portion 50. The corresponding part 12*b*, which is shown as being larger in size, may be secured by techniques known in the art, such as by being sewn, to the outer surface 30 of the overlapped section 56 of the left portion 52 of the gown 10 proximate a junction 68 at which the top edge 46 or bias bound hem of the neck opening 40 meets the vertical edge 58 or hem of the left portion 52. Although discussed above as being separate hook and loop parts 12*a*, 12*b*, in one example, the corresponding parts 12*a*, 12*b* can each include a combination of hooks and loops.

The easy release fastener 12, which again can define a hook and loop fastener, in one example, can include an average peel strength of no greater than 1.5 pounds per inch of width (PIW). In another example, the average peel strength is no greater than 1.0 PIW. In another example, the average peel strength is no greater than 0.8 PIW. In another example, the average peel strength is no greater than 0.5 PIW. In another example, the average peel strength is no greater than 0.4 PIW. In another example, the average peel strength is in a range from 0.1 PIW to 1.5 PIW. In another example, the average peel strength is in a range from 0.1 PIW to 1.0 PIW. In another example, the average peel strength is in a range from 0.2 PIW to 0.8 PIW. In another example, the average peel strength is in a range from 0.3 PIW to 0.6 PIW. In another example, the average peel strength is in a range from 0.3 PIW to 0.5 PIW. In another example, the average peel strength is in a range from 0.35 PIW to 0.5 PIW. In another example, the average peel strength is 0.3, 0.35, 0.4, 0.45, 0.5, or 0.55 PIW. The average peel strength can be determined using the ASTM D5170 test method.

The fastener 12 also can include, in one example, an average shear strength of no greater than 25 PSI. In another example, the average shear strength is no greater than 20 PSI. In another example, the average shear strength is no greater than 18 PSI. In another example, the average shear strength is no greater than 15 PSI. In another example, the average shear strength is no greater than 9 PSI. In another example, the average shear strength is in a range from 1 pound per square inch (PSI) to 25 PSI. In another example, the average shear strength is in a range from 5 PSI to 25 PSI. In another example, the average shear strength is in a range from 5 PSI to 20 PSI. In another example, the average shear strength is in a range from 5 PSI to 18 PSI. In another example, the average shear strength is in a range from 7 PSI to 18 PSI. In another example, the average shear strength is in a range from 7 PSI to 15 PSI In another example, the average shear strength is in a range from 7 PSI to 10 PSI. In another example, the average shear strength is 5, 7, 8, 8.5, 9, 10, 15, 20, or 25 PSI. The average shear strength can be determined using the ASTM D5169 test method.

The easy release fastener 12 can be made of natural and/or synthetic materials, which can withstand standard commercial laundering conditions on a repeated basis. In one example, the fastener 12 can be made of polyester, nylon, aramid, or combinations thereof. In another example, the fastener 12 can be made of metal, e.g., stainless steel. In one example, the fastener 12 cannot be made of polypropylene. In one example, the fastener 12 can withstand no less than about 50 wash/dry/use cycles, where the wash(ing) and dry(ing) cycles are commercial laundering conditions. In another example, the fastener 12 can withstand no less than about 75 wash/dry/use cycles. In yet another example, the fastener 12 can withstand no less than about 100 wash/dry/use cycles. In another example, the fastener 12 can withstand repeated wash/dry cycles that include acidic and/or basic pH swing conditions in the wash liquor and drying temperatures of at least 200° F.

The corresponding parts 12*a*, 12*b* in FIG. 1 again are shown having different sizes, i.e., corresponding part 12*a* is smaller in size than corresponding part 12*b*, which can help accommodate different sized wearers of the gown. It should be understood that the corresponding parts 12*a*, 12*b* may be of any size, including the same size or corresponding part 12*a* may be larger in size than corresponding part 12*b*, so long as the fastener 12 continues to maintain the above discussed average peel strength and/or average shear strength. In one example, part 12*a* is 1 square inch and corresponding part 12*b* is 2 square inches. In addition, although illustrated as squares, the corresponding parts 12*a*, 12*b* generally may be any shape, including, but not limited to, rectangles, circles, triangles, etc., and the like, again, so long as the fastener 12 maintains the above discussed average peel strength and/or average shear strength. Furthermore, although not shown, it is contemplated that a plurality of fastener parts 12*a* and/or 12*b*, e.g., small(er) sized parts, may be placed closely together to generally define part 12*a* and/or 12*b*.

One example of an easy release fastener 12 suitable for use here is the Hook 65 and Loop 2000 product available from Velcro USA Inc. of Manchester, N.H. Another example of an easy release fastener 12 suitable for use here is the Hook 88 and Loop 2000 product available from Velcro USA Inc. of Manchester, N.H. Another example of an easy release fastener 12 suitable for use here is the Hook 46 and Loop 8000 HI-GARDE® Hook and Loop Fastener, which is available from Velcro USA Inc. of Manchester, N.H. Still another example of easy release fasteners 12 that can be suitable for use include those of the VELCRO® Brand Omni-Tape Hook and Loop Fastener, which has alternating rows of hooks and loops on a single side, available from WBC Industries, Inc. of Westfield, N.J.

With continuing reference now to FIGS. 1 and 2, the second fastener 14, which is not an easy release fastener, defines a tie fastener having cooperating first and second tie parts 14*a*, 14*b*. Each tie part 14*a*, 14*b* may be a twill tape. The first tie part 16*a* may be secured by techniques known in the art, such as by being sewn, into the vertical edge 58 or hem of the right portion 50 of the central body 34 about intermediate the top 24 and bottom 26 of the gown 10, at a location which approximates an abdominal region or waist area of a wearer upon donning of the gown 10. The cooperating or corresponding second tie 14*b* may be secured by techniques known in the art, such as by being sewn, to the outer surface 30 of the left portion 52 of the central body 34 of the gown 10 about intermediate the top 24 and bottom 26 of the gown 10 and spaced apart from the vertical edge 58 of the left portion 52.

Figure 1B:
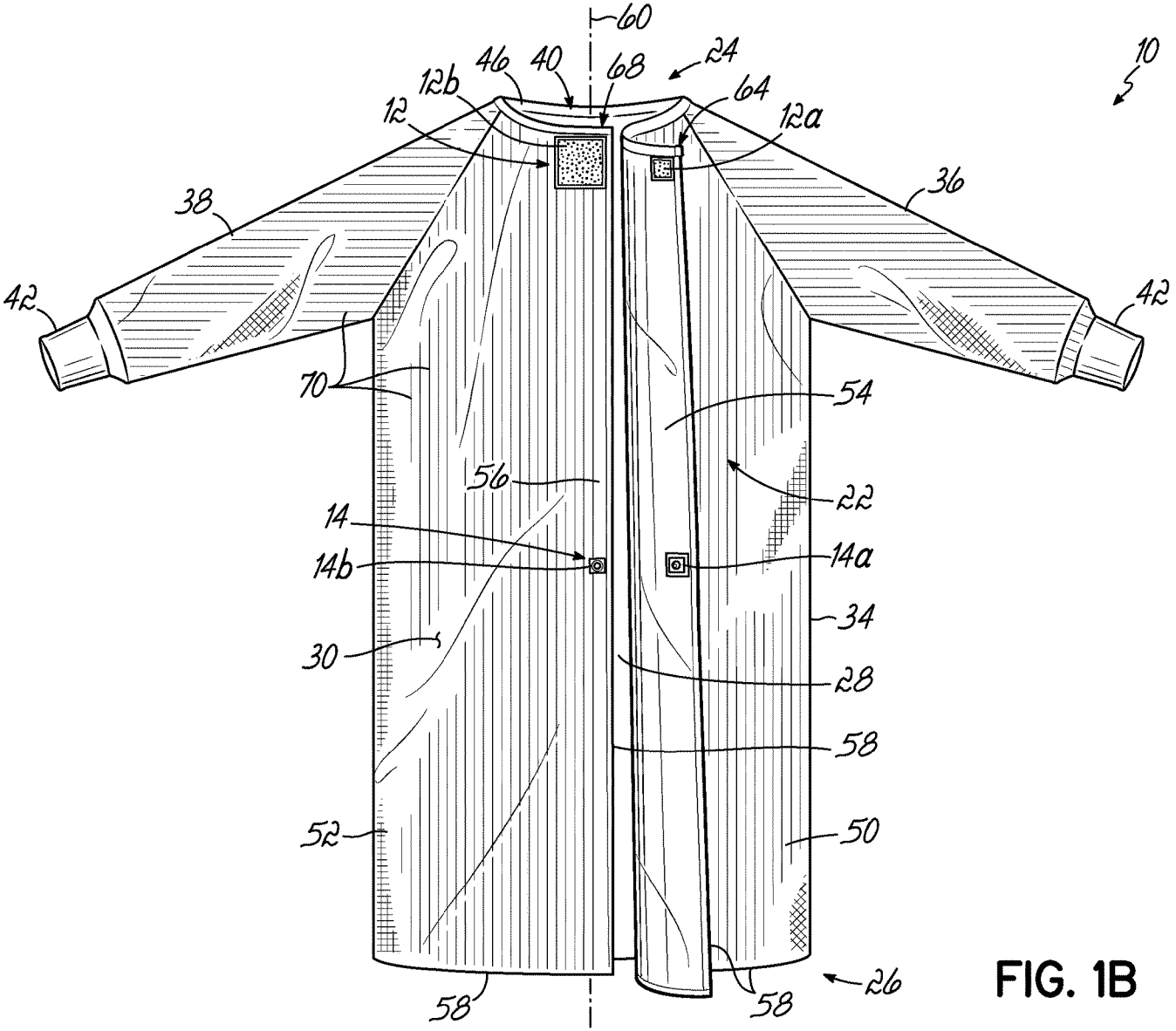
FIG. 1B is a back elevational view of an isolation gown, in a generally open and unsecured position, in accordance with another embodiment of the present invention.

In an alternate embodiment, as shown in FIG. 1B, the second fastener 14, which is not an easy release fastener, defines a snap having a mating male and female part 14*a*, 14*b*. The male (or female) part 14*a* may be secured by techniques known in the art, such as by being sewn, to the inner surface 28 of the overlapping section 54 of the right portion 50 of the gown 10 on or proximate the vertical edge 58 or hem of the right portion 50 of the central body 34 about intermediate the top 24 and bottom 26 of the gown 10, at a location which approximates an abdominal region or waist area of a wearer upon donning of the gown 10. The cooperating or corresponding second part 14*b* may be secured by techniques known in the art, such as by being sewn, to the outer surface 30 of the left portion 52 of the central body 34 of the gown 10 about intermediate the top 24 and bottom 26 of the gown 10 and spaced apart from the vertical edge 58 of the left portion 52. Although not shown, in one example, multiple cooperating or corresponding second parts 14*a* and/or 14*b* may be situated, e.g., generally along a horizontal line, in the appropriate region to accommodate different sized wearers of the gown.

The snap 14 can be made of metal, plastic, and the like, and optional reinforcement tabs (not shown), such as twill tape, can be secured to the gown 10 also by techniques known in the art, such as by being sewn, beneath one or both parts 14*a*, 14*b* of the snap 14 to create a reinforced base for the snap 14 with the snap 14 being secured thereon. Alternately, the snap 14 may be reinforced by self-fabric gathered or pinched in the attachment operation.

Figure 1C:
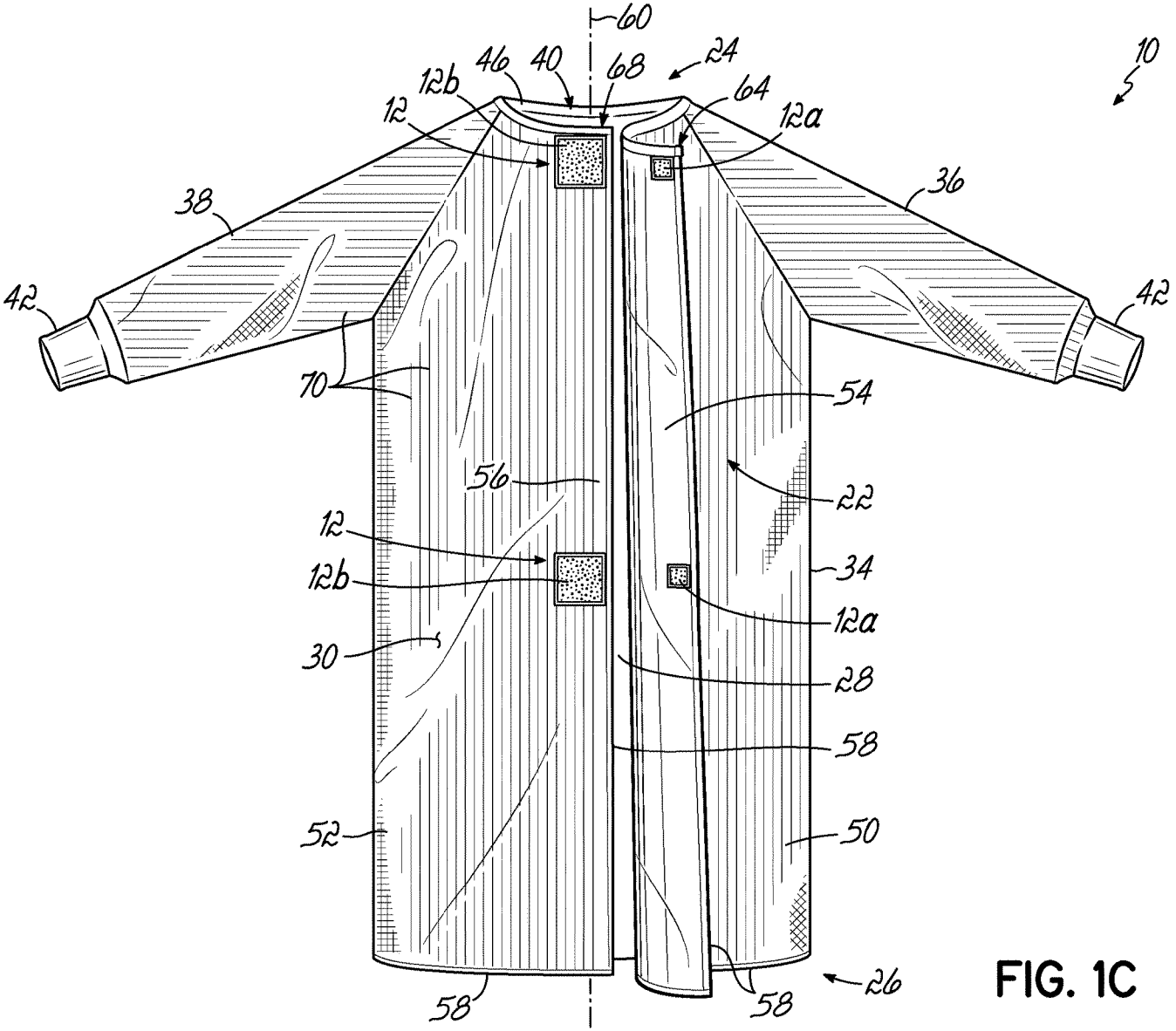
FIG. 1C is a back elevational view of an isolation gown, in a generally open and unsecured position, in accordance with another embodiment of the present invention.

In another embodiment, as shown in FIG. 1C, the second fastener 14, e.g., the tie fastener or snap, is replaced with another or second easy release fastener 12 having corresponding parts 12*a* and 12*b*. The hook (or loop) part 12*a* may be secured by techniques known in the art to the inner surface 28 of the overlapping section 54 of the right portion 50 of the gown 10 proximate a junction 64 at which the top edge 46 or bias bound hem of the neck opening 40 meets the vertical edge 58 or hem of the right portion 50. The corresponding part 12*b* may be secured by techniques known in the art, such as by being sewn, to the outer surface 30 of the left portion 52 of the central body 34 of the gown 10 about intermediate the top 24 and bottom 26 of the gown 10 and spaced apart from the vertical edge 58 of the left portion 52. It should be understood that the two easy release fasteners 12 may be identical in size (although shown as different sizes here), shape, average peel strength, average shear strength, and/or material, etc., or may be dissimilar altogether. And although not shown, in one example, multiple cooperating or corresponding second parts 12*a* and/or 12*b* may be situated, e.g., generally along a horizontal line, in the appropriate region to accommodate different sized wearers of the gown.

Figure 4:
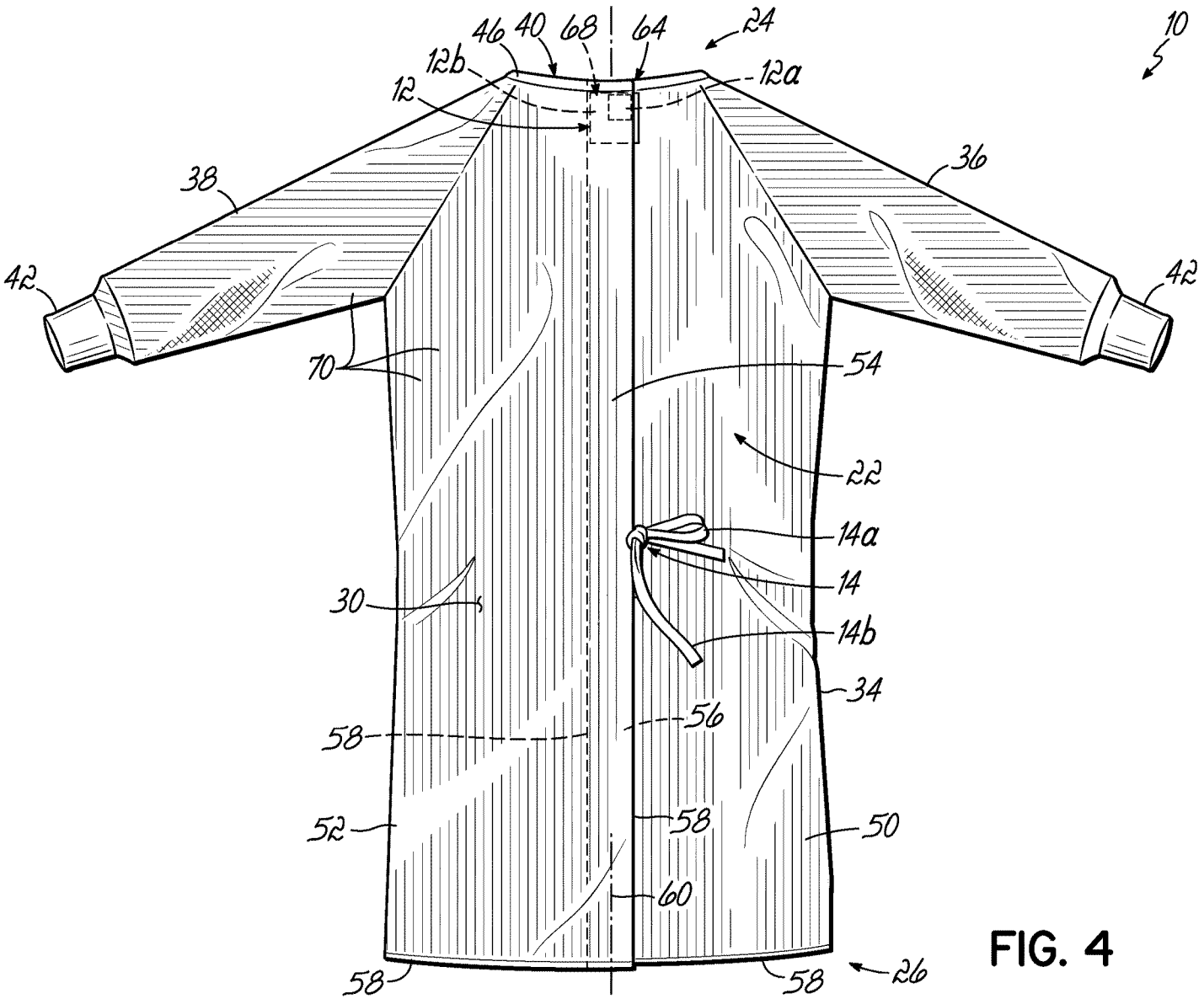
FIG. 4 is a back elevational view of the isolation gown of FIG. 2 in accordance with another embodiment of the present invention.

In an alternative embodiment, as shown in FIG. 4, it should be readily appreciated by those skilled in the art that the gown 10 may be reconfigured in a generally reversed fashion so as to be donned and securely fastened on the right side rather than the left, such as to better accommodate left-handed wearers. That is, the left portion 52 alternatively can include overlapping section 54 and the right portion 50 can include corresponding overlapped section 56 with the fasteners 12, 14 repositioned accordingly.

With respect to FIGS. 1-4, it should be appreciated that more or less fasteners 12, 14 may be provided with the gown 10, the locations thereof may be re-located altogether or adjusted up or down and/or left or right, as needed, and fastener 14, as indicated above, may be replaced or interchanged with a like fastener or another easy release fastener, while still retaining the overall benefits of the reusable, rear opening isolation gown 10. In one example, the tie or snap fastener 14 may be replaced with a hook and loop closure (e.g., Velcro®), magnets, clasps, and the like, which are not easy release fasteners 12, while still retaining the overall benefits of the reuseable, rear opening isolation gown 10.

The isolation gown 10 can be provided in any number of desired lengths and sizes. The isolation gown 10 may be provided in any color, as desired. In one example, the isolation gown 10 is yellow in color. The isolation gown 10 also may optionally include pockets (not shown) or other surface features. In one example, a verifiable tracking system (not shown), such as a bar code or radio frequency chip, may be included on or in the gown 10, such as to track the number of laundering cycles of the gown 10, for example.

The central body 34 and sleeves 36, 38 of the gown 10 can be constructed of various materials such as conventional materials that are typically used in the construction of isolation gowns. Fabric construction can be woven, nonwoven, or knitted. In one example, the fabric construction is a woven plain weave. In another example, the sleeves may be a double needle sleeve construction. The fabric material can include natural and/or synthetic fibers and may be lint free, as desired. In one example, the fabric includes polyester and/or cotton. In another example, the central body 34 and/or sleeves 36, 38 are substantially polyester, substantially cotton, or a polyester/cotton blend (e.g., a 50/50). The central body 34 and/or sleeves 36, 38 also may incorporate ESD (electrostatic dissipative)/anti-static yarns 70 therein. The ESD yarns 70 can include nylon or carbon fibers, and the like. In one example, the ESD yarns 70 are about 1% of the total material of the gown 10, but may be provided in a greater or lesser amount as desired.

The terminal cuffs 42 can be constructed of the same or different materials than those used for the central body 34 or sleeves 36, 38. Fabric construction can be woven, non-woven, or knitted. The fabric material can include natural and/or synthetic fibers and may be lint free, as desired. In one example, the terminal cuff 42 is a knitted cuff, which can be of a different material than the sleeves 36, 38. In one example, the knitted cuff is substantially polyester, substantially cotton, or a cotton/polyester blend (e.g., 50/50 blend). In another example, the terminal cuff 42 may be elastic and composed of an elastic material, such as rubber, latex, nitrile, vinyl, and the like. In other examples, the gown 10 may be fabricated with cuffs 42 altogether, thumbhole-type retention loops may be employed at the end of each sleeve 36, 38, or the sleeve 36, 38 may simply terminate with a hemmed or otherwise finished opening for the hand.

In one embodiment, the central body 34, sleeves 36, 38, and/or cuffs 42 include or are composed solely of liquid resistant material, such as polyester, and/or are liquid resistant so as to conform to at least minimum standards established for Level 1 classification by AAMI PB70 Standard. In one example, the fabric for the central body 34, sleeves 36, 38, and/or cuffs 42 may be provided with a liquid resistant finish, such as a fluorocarbon based finish. In another example, the fabric may be provided with an antimicrobial finish. In another embodiment, additional layer(s) or reinforcements, laminates, chemical finishes, and/or films (e.g., plastic films) may be incorporated into the gown 10 to provide the necessary liquid resistance.

The rear opening isolation gown 10 is donned in a rear-opening orientation, as is known in the art. That is, the right sleeve 36 and left sleeve 38 receive a wearer's arms with the optional terminal cuffs 42 being situated generally ideally around the wearer's wrists. Medical gloves may be worn over the hands and may be placed over all or a portion of the cuffs 42. The neck opening 40 accommodates the neck of a wearer with the central body 34 wrapping around the torso area of a wearer so that the overlapping section 54 overlaps the corresponding overlapped section 56 at the back of the wearer, when an appropriately sized gown 10 is properly donned. After the overlapping section 54 overlaps the corresponding overlapped section 56, the first and second parts 12*a*, 12*b*, 14*a*, 14*b* of the fasteners 12, 14 can mate and/or cooperate with another for securing the right and left portions 50, 52 together thereby providing a secure, full body fit for a wearer that facilitates ease of adjustment.

Figure 5B:
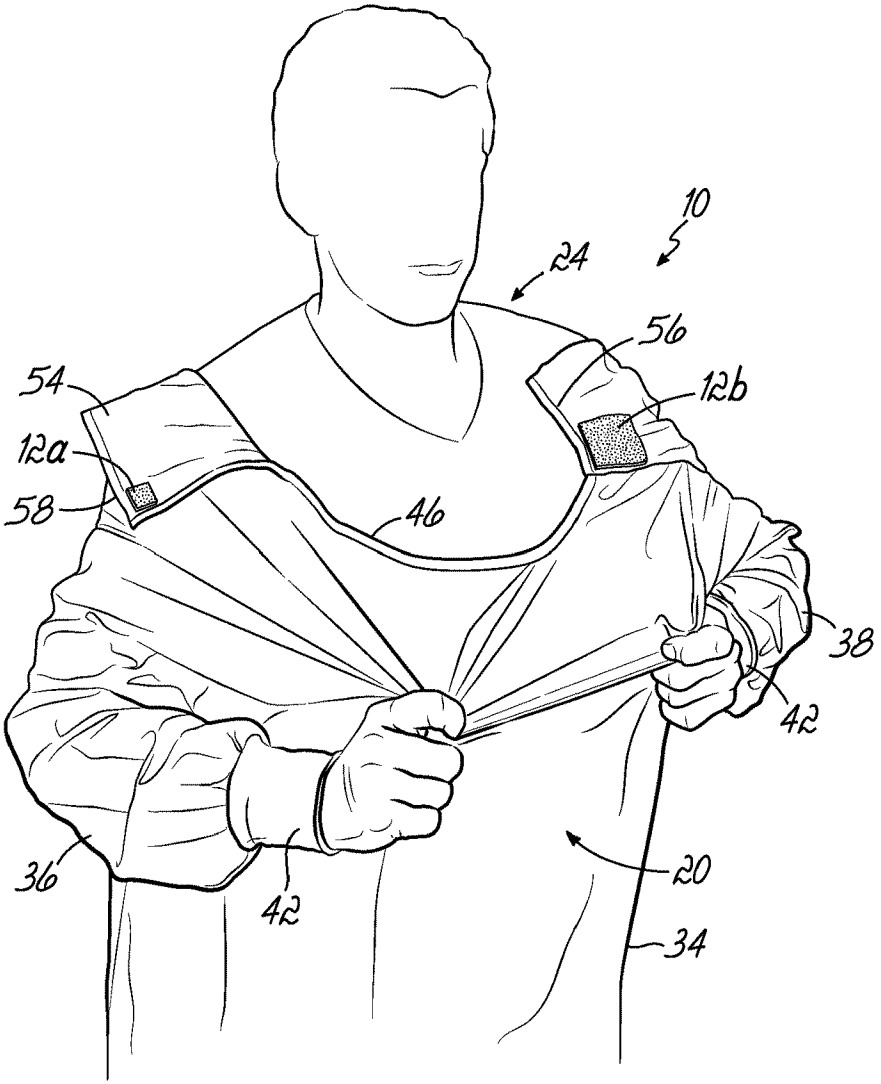
FIGS. 5A and 5B illustrate a doffing method for the reusable rear opening isolation gown with easy release fastener, in accordance with an embodiment of the present invention.
Figure 5A:
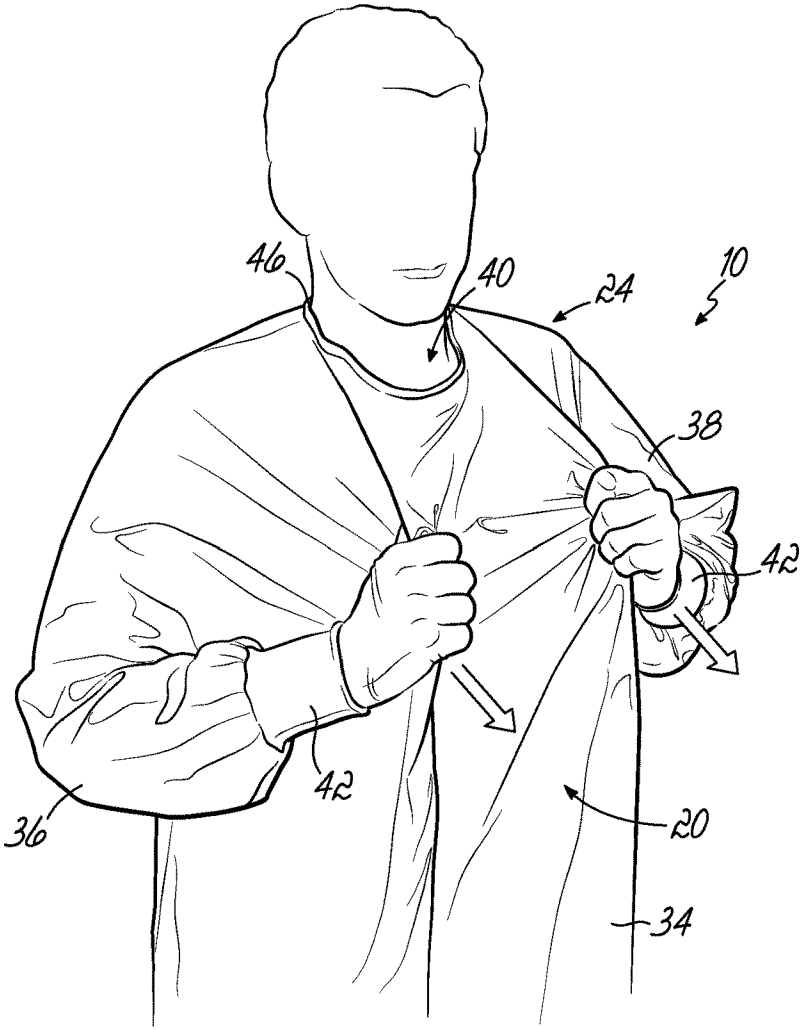

For doffing, as shown in FIGS. 5A and 5B, the isolation gown 10 can be removed via a "pull forward" method that is consistent with how current users of disposable isolation gowns are accustomed to removing such gowns. More specifically, the wearer (or another individual) can grab generally the front 20 of the gown 10 with one or two hands (and optionally with crossed arms), such as generally about the chest region, and pull forcefully forward or away from the body. With enough force, the corresponding parts 12*a*, 12*b* of the easy release fastener 12 pull apart/become undone due to the average peel strength and/or average shear strength of the fastener(s) 12, thereby freeing the overlapping portion 54 from the overlapped portion 56 and allowing the wearer to complete the de-gowning process. Other variations and modifications to the pull forward method can be appreciated by those skilled in the art. Such doffing is performed without substantial risk of damaging (e.g., tearing) the gown and without substantial risk of the transfer of potentially harmful microorganisms, body fluids, and/or particulate material, to the neck or hair on the head or neck of a wearer. To that end, the doffing method eliminates the need to actively undo/untie any backside fasteners, and eliminates an opportunity for the wearer to touch their hair or neck during the doffing process with potentially contaminated gloves, thereby providing for safer removal of the gown after use. During the gown 10 removal process, the wearer can easily turn the contaminated outer surface 30 toward the inside. Thereafter, the reusable gown 10 can be subjected to commercial laundering to clean and sanitize the gown for reuse.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method and illustrative example shown and described. Accordingly, departures may be made from such details without departing from the spirit or scope of applicant's general inventive concept.

What is claimed is:

1. A rear opening isolation gown comprising:

a central body adapted to wrap around a torso area of a wearer, a pair of opposing left and right sleeves that cooperate with and extend in a direction away from the central body, and a neck opening that is adapted to accommodate a neck of the wearer, the central body and right and left sleeves including a front and a back, the back of the central body being completely separated into a right portion and a left portion, with each of the left and right portions extending along the entire vertical length of the back of the gown and one of the right or left portions including an overlapping section and the other portion including a corresponding overlapped section that is defined when the gown is donned and secured; and a plurality of fasteners provided at the back, with each fastener having corresponding first and second parts that cooperate with one another to define the fastener and secure the right and left portions together, each first part being situated on the overlapping section of the right or left portion and each corresponding second part situated on the corresponding overlapped section of the other portion of the gown, and at least one of the plurality of fasteners being a hook and loop fastener having an average peel strength no greater than 1.5 pounds per inch of width (PIW) and an average shear strength of no greater than 25 PSI, that is situated proximate the neck opening and that facilitates ease of adjustment and donning and doffing of the gown, wherein when the front of the gown is pulled away from the wearer with enough force the hook and loop fastener comes undone without damaging the gown thereby allowing for reuse of the gown.

2. The rear opening isolation gown of claim 1 wherein the hook and loop fastener has an average peel strength of no greater than 0.4 pounds per inch of width (PIW).

3. The rear opening isolation gown of claim 1 wherein the hook and loop fastener has an average shear strength of no greater than 9 PSI.

4. The rear opening isolation gown of claim 1 wherein the central body and sleeves are formed from a lint free material.

5. The rear opening isolation gown of claim 1 wherein the right and left sleeves each have a terminal cuff, and wherein the central body, sleeves, and cuffs are formed from a lint free material.

6. The rear opening isolation gown of claim 1 wherein the gown is formed from a lint free material.

7. The rear opening isolation gown of claim 1 wherein at least another of the plurality of fasteners is selected from a snap, hook and loop fastener, tie, or magnetic closure.

8. The rear opening isolation gown of claim 1 wherein at least another of the plurality of fasteners is a second hook and loop fastener.

9. The rear opening isolation gown of claim 1 wherein one of the first or second parts of the hook and loop fastener is larger in size than the other.

10. The rear opening isolation gown of claim 1 wherein the right portion includes the overlapping section and the left portion includes the corresponding overlapped section.

11. A rear opening isolation gown comprising:

a central body that is adapted to wrap around a torso area of a wearer, a pair of opposing left and right sleeves that cooperate with and extend in a direction away from the central body, and a neck opening that is adapted to accommodate a neck of the wearer, the central body and right and left sleeves including a front and a back and being formed from a lint free material, the back of the central body being completely separated into a right portion and a left portion, with each of the right and left portions extending along the entire vertical length of the back of the gown and one of the right or left portions including an overlapping section and the other portion including a corresponding overlapped section that is defined when the gown is donned and secured; and a plurality of fasteners provided at the back, with each fastener having corresponding first and second parts that cooperate with one another to define the fastener and secure the right and left portions together, each first part being situated on the overlapping section of the right or left portion and each corresponding second part situated on the corresponding overlapped section of the other portion of the gown, and at least one of the plurality of fasteners being a hook and loop fastener having an average peel strength in a range from 0.1 PIW to 1.5 PIW and an average shear strength in a range from 5 PSI to 25 PSI, that is situated proximate the neck opening, and that facilitates ease of adjustment and donning and doffing of the gown, wherein when the front of the gown is pulled away from the wearer with enough force the hook and loop fastener comes undone without damaging the gown thereby allowing for reuse of the gown.

12. The rear opening isolation gown of claim 11 wherein the hook and loop fastener has an average peel strength in a range from 0.2 PIW to 0.8 PIW.

13. The rear opening isolation gown of claim 11 wherein the hook and loop fastener has an average shear strength in a range from 5 PSI to 10 PSI.

14. The rear opening isolation gown of claim 11 wherein the hook and loop fastener has an average peel strength in a range from 0.3 PIW to 0.6 PIW and an average shear strength in a range from 7 PSI to 10 PSI.

15. The rear opening isolation gown of claim 11 wherein at least another of the plurality of fasteners is selected from a snap, hook and loop fastener, tie, or magnetic closure.

16. The rear opening isolation gown of claim 11 wherein at least another of the plurality of fasteners is a second hook and loop fastener.

17. The rear opening isolation gown of claim 11 wherein one of the first or second parts of the hook and loop fastener is larger in size than the other.

18. The rear opening isolation gown of claim 11 wherein the right portion includes the overlapping section and the left portion includes the corresponding overlapped section.

19. A method of doffing a rear opening isolation gown comprising:

pulling apart first and second parts of a hook and loop fastener on a back of the rear opening isolation gown that securely cooperate with one another to define the fastener by pulling a front of the rear opening isolation gown away from a wearer of the gown with enough force to undo the hook and loop fastener without damaging the gown thereby allowing for reuse of the gown, the hook and loop fastener having an average peel strength in a range from 0.1 PIW to 1.5 PIW and an average shear strength in a range from 5 PSI to 25 PSI and being situated proximate a neck opening of the gown.

20. The method of claim 19 wherein one of the first or second parts of the hook and loop fastener is larger in size than the other.

21. The method of claim 19 wherein the gown is formed from a lint free material.

* * * * *